US010467953B2

(12) United States Patent
Chang et al.

(10) Patent No.: US 10,467,953 B2
(45) Date of Patent: Nov. 5, 2019

(54) PIXEL DRIVING CIRCUIT AND ORGANIC LIGHT-EMITTING DIODE (OLED) DISPLAY

(71) Applicant: Shenzhen China Star Optoelectronics Semiconductor Display Technology Co., Ltd., Shenzhen, Guangdong (CN)

(72) Inventors: Bobiao Chang, Guangdong (CN); Xiaolong Chen, Guangdong (CN); Yi-chien Wen, Guangdong (CN); Ming-jong Jou, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/765,707

(22) PCT Filed: Dec. 13, 2017

(86) PCT No.: PCT/CN2017/115989
§ 371 (c)(1),
(2) Date: Apr. 3, 2018

(87) PCT Pub. No.: WO2019/061848
PCT Pub. Date: Apr. 4, 2019

(65) Prior Publication Data

US 2019/0103054 A1 Apr. 4, 2019

(30) Foreign Application Priority Data

Sep. 29, 2017 (CN) ..... 2017 1 0902396

(51) Int. Cl.
*G09G 3/30* (2006.01)
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0819* (2013.01);
(Continued)

(58) Field of Classification Search
CPC ..... G09G 3/3266; G09G 2330/028; G09G 2320/0233; G09G 2320/043;
(Continued)

(56) References Cited

U.S. PATENT DOCUMENTS

2006/0244694 A1 11/2006 Kim
2008/0143653 A1* 6/2008 Shishido ..... G09G 3/3233 345/78

FOREIGN PATENT DOCUMENTS

CN 104008726 A 8/2004
CN 106960659 A 7/2007
(Continued)

*Primary Examiner* — Jennifer T Nguyen
(74) *Attorney, Agent, or Firm* — Andrew C. Cheng

(57) ABSTRACT

The present disclosure relates to a pixel driving circuit and an organic light-emitting diode (OLED) display having the pixel driving circuit. The pixel driving circuit adopts a 6T2C (six transistors and two capacitors) structure to compensate a threshold voltage of the driving thin film transistor (TFT) in the pixel. As such, a current passing through the OLED may not be related to the threshold voltage of the driving TFT. So as to eliminate the improper image-displaying of the OLED display resulting from the drifting of the threshold voltage of the driving TFT.

5 Claims, 7 Drawing Sheets

(52) U.S. Cl.
CPC ..... *G09G 2300/0852* (2013.01); *G09G 2300/0861* (2013.01); *G09G 2310/0262* (2013.01); *G09G 2320/043* (2013.01); *G09G 2320/045* (2013.01)

(58) Field of Classification Search
CPC ... G09G 2300/0819; G09G 2310/0202; G09G 2300/0852; G09G 2310/0262; G09G 3/3225
USPC ..... 345/76, 690; 315/169.3
See application file for complete search history.

(56) References Cited

FOREIGN PATENT DOCUMENTS

| | | |
|---|---|---|
| CN | 103150991 A | 6/2013 |
| CN | 107170412 A | 9/2017 |

* cited by examiner

PIXEL DRIVING CIRCUIT AND ORGANIC LIGHT-EMITTING DIODE (OLED) DISPLAY

BACKGROUND OF THE INVENTION

1. Field of the Invention

The present disclosure relates to organic electroluminescence field, more particular to a pixel driving circuit and an organic light-emitting diode (OLED) display.

2. Discussion of the Related Art

Organic light-emitting diode (OLED) displays have become popular flat panel display products due to the attributes, such as self-illuminating, wide viewing angle, short reaction time, high luminous efficiency, wide color gamut, low operating voltage, thin thickness, can be produced in large-size, flexible display, and simple manufacturing process. Moreover, the OLED displays also have potential of low cost.

With respect to OLED displays, thin film transistors (TFTs) are often adopted in conjunction with capacitor storage signals to control the gray scale of the OLED. So as to drive the OLED at a constant current. Each of the pixels at least includes two TFT and a storage capacitor, i.e., each of the pixels has a 2T1C structure. FIG. 1 is a circuit diagram of a pixel driving circuit of a conventional OLED displays. Referring to FIG. 1, the pixel driving circuit of the conventional OLED displays may include two TFT and a capacitor. Specifically, the pixel driving circuit of the conventional OLED displays may include a switch TFT T1, a driving TFT T2, and a storage capacitor $C_{st}$. Driving current of the OLED is controlled by the driving TFT T2. The current may satisfy the equation: $I_{OLED}=k(V_{GS}-V_{th})^2$, wherein k is an intrinsic conductance factor of the driving TFT T2, which is determined by the characteristic of the driving TFT T2. $V_{th}$ is threshold voltage of the driving TFT T2. $V_{gs}$ is a voltage between a gate and a source of the driving TFT T2. Due to the long-term operation, the threshold voltage $V_{th}$ of the driving TFT T2 may drift, causing the driving current of the OLED to change. So that, the OLED display may not operate properly, which may lower-down the quality of the image-displaying.

SUMMARY

In one aspect, the present disclosure relates to a pixel driving circuit, including: a first thin film transistor (TFT), a second TFT, a third TFT, a fourth TFT, a fifth TFT, a sixth TFT, a first capacitor, a second capacitor, and an organic light-emitting diode (OLED); a gate of the first TFT electrically connecting to a first node, a source of the first TFT electrically connecting to a second node, and a drain of the first TFT electrically connecting to a third node; a gate of the second TFT being configured to receive emission controlling signals; a source of the second TFT being configured to receive initializing signals or data signals, and a drain of the second TFT electrically connecting to the second node; a gate of the third TFT being configured to receive the emission controlling signals, a source of the third TFT being configured to receive a positive voltage of a power supply, and a drain of the third TFT electrically connecting to the second node; a gate of the fourth TFT being configured to receive first scanning signals, a source of the fourth TFT electrically connecting to the third node, and a drain of the fourth TFT electrically connecting to the first node; a gate of the fifth TFT being configured to receive second scanning signals, a source of the fifth TFT electrically connecting to the second node, and a drain of the fifth TFT electrically connecting to the first node; a gate of the sixth TFT being configured to receive the emission controlling signals; a source of the sixth TFT electrically connecting to the third node, and a drain of the sixth TFT being configured to receive a negative voltage of the power supply; one end of the first capacitor electrically connecting to the first node, and the other end of the first capacitor electrically connecting to the second node; one end of the second capacitor electrically connecting to the first node, and other end of the second capacitor being grounded.

In one example, the first TFT, the second TFT, the fourth TFT, and the fifth TFT are P-type TFTs, and the third TFT and the sixth TFT are N-type TFTs.

In one example, the pixel driving circuit is configured to perform a potential initializing operation, a threshold voltage storing operation, and an emission displaying operation; when the pixel driving circuit performs the potential initialization operation, the emission controlling signals and the second scanning signals are configured to be at a low potential, the first scanning signals are configured to be at a high potential, and the source of the second TFT receives the initializing signals at the low potential; when the pixel driving circuit performs the threshold voltage storing operation, the emission controlling signals and the first scanning signals are configured to be at the low potential, the second scanning signals are configured to be at the high potential, and the source of the second TFT is configured to receive the data signals at the high potential; when the pixel driving circuit performs the emission displaying operation, the emission controlling signals, the first scanning signals, and the second scanning signals are configured to be at the high potential.

In another aspect, the present disclosure relates to a pixel driving circuit, including: a potential initialization module, a threshold voltage storing module, an emission displaying module, and an OLED; the potential initialization module being configured to conduct a potential initializing operation according to emission signals and the second scanning signals at a low potential, and first scanning signals and initializing signals at a high potential during a potential initializing phase; the threshold voltage storing module being configured to conduct a threshold voltage storing operation according to the emission signals and the first scanning signals at the low potential, and the second scanning signals and the data signals at the high potential during a threshold voltage storing phase; the emission displaying module being configured to drive the OLED to illuminate according to the emission signals, the first scanning signals, and the second scanning signals at the high potential during an emission displaying phase; wherein a current driving the OLED to illuminate is not related to a threshold voltage of the emission displaying module.

In one example, the potential initialization module includes a second TFT, a fifth TFT, a first capacitor, and a second capacitor; a gate of the second TFT is configured to receive the emission controlling signals; a source of the second TFT is configured to receive the initializing signals or the data signals, and a drain of the second TFT electrically connects to a second node; a gate of the fifth TFT is configured to receive the second scanning signals, a source of the fifth TFT electrically connects to the second node, and a drain of the fifth TFT electrically connects to a first node; one end of the first capacitor electrically connects to the first node, and the other end of the first capacitor electrically connects to the second node; one end of the second capacitor electrically connects to the first node, and other end of the second capacitor is grounded.

In one example, the threshold voltage storing module includes a first TFT, a second TFT, a fourth TFT, the first capacitor, and the second capacitor; a gate of the first TFT electrically connects to the first node, a source of the first TFT electrically connects to the second node, and a drain of the first TFT electrically connects to a third node; a gate of the fourth TFT is configured to receive the first scanning signals, a source of the fourth TFT electrically connects to the third node, and a drain of the fourth TFT electrically connects to the first node.

In one example, the emission displaying module includes the first TFT, a third TFT, a sixth TFT, the first capacitor, and the second capacitor; a gate of the third TFT is configured to receive the emission controlling signals, a source of the third TFT is configured to receive a positive voltage of a power supply, and a drain of the third TFT electrically connects to the second node; a gate of the sixth TFT is configured to receive the emission controlling signals; a source of the sixth TFT electrically connects to the third node, and a drain of the sixth TFT is configured to receive a negative voltage of the power supply.

In one example, the first TFT, the second TFT, the fourth TFT, and the fifth TFT are P-type TFTs, and the third TFT and the sixth TFT are N-type TFTs.

In one example, the P-type TFT is a PMOS TFT, and the N-type TFT is a NMOS TFT.

In view of the above, the pixel driving circuit may adopt the pixel structure of 6T2C to compensate the threshold voltage of the driving TFT, i.e., the first TFT, in the pixel. As such, the current passing through the OLED may not be related to the threshold voltage of the driving TFT, i.e., the first TFT. So as to eliminate the improper image-displaying of the OLED display resulting from the drifting of the threshold voltage of the driving TFT.

DETAILED DESCRIPTION OF THE EMBODIMENTS

Figure 1:
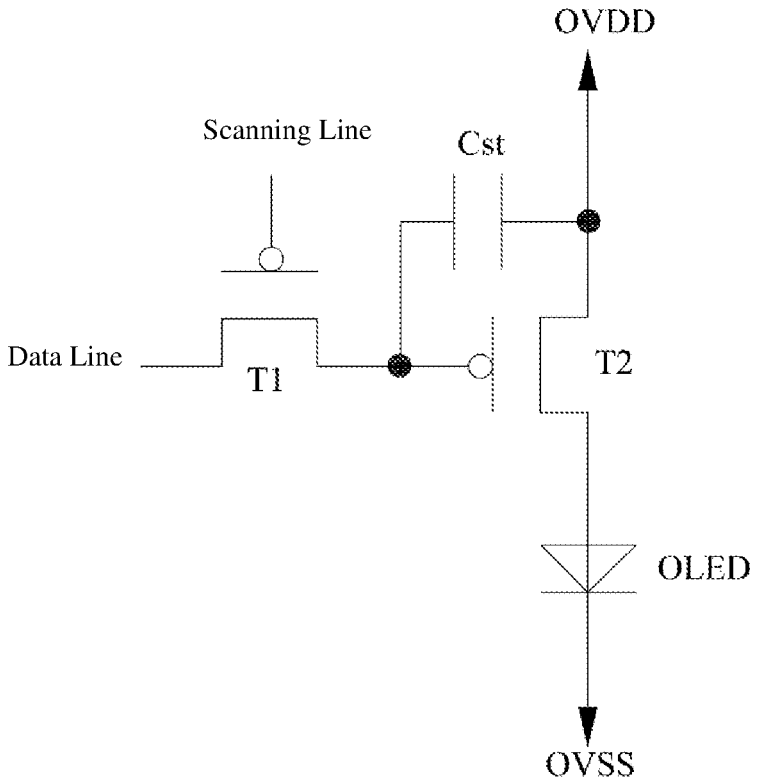
FIG. 1 (Prior Art)
FIG. 1 is a circuit diagram of a pixel driving circuit of a conventional organic light-emitting diode (OLED) display.

Following embodiments of the invention will now be described in detail hereinafter with reference to the accompanying drawings. However, there are plenty of forms to implement the present disclosure, and the invention should not be construed as limitation to the embodiments. Rather, these embodiments are provided to explain the principles of the invention and its practical application, thereby enabling other person skilled in the art to understand each of the embodiments in the invention and various modifications being suitable for the particular application.

In the drawings, the thicknesses of layers and regions may be exaggerated for clarity. Same reference numerals refer to the same components throughout the specification and the drawings.

Figure 2:
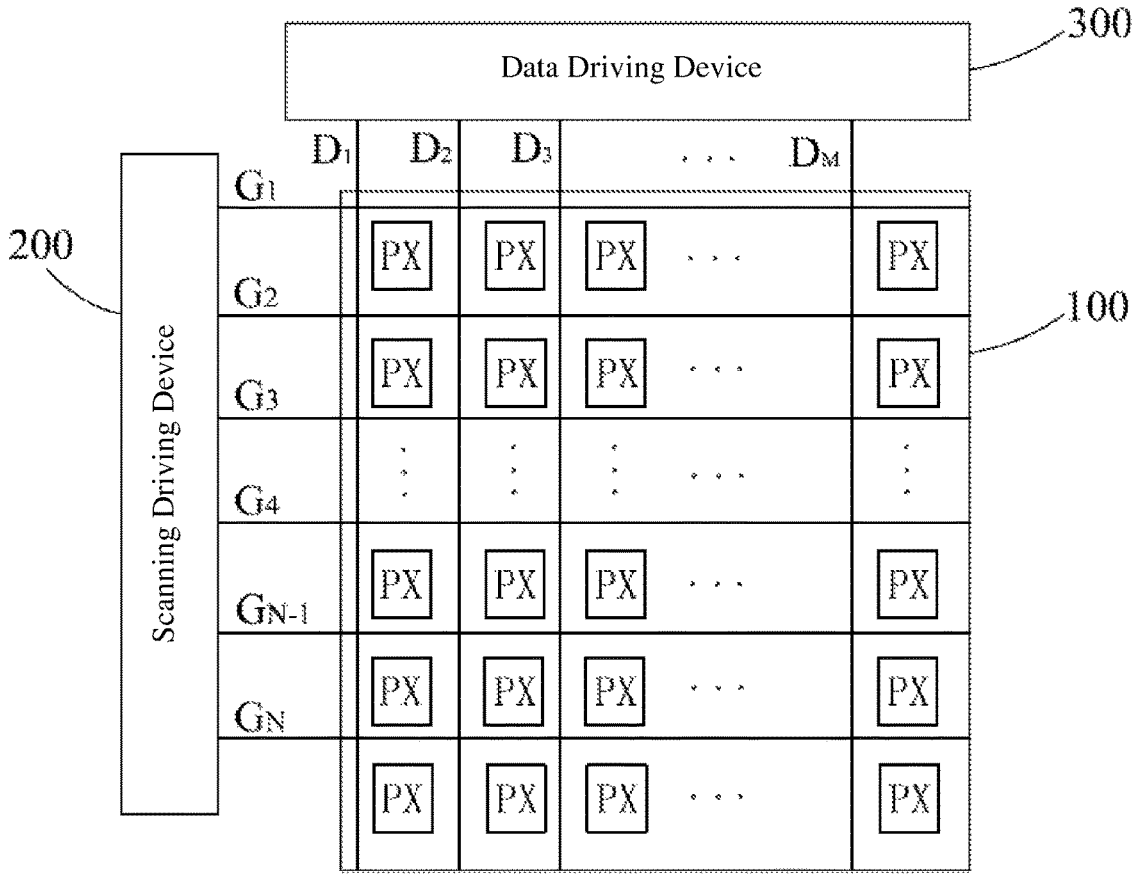
FIG. 2 is a schematic view of a OLED display in accordance with one embodiment in the present disclosure.

FIG. 2 is a schematic view of a OLED display in accordance with one embodiment in the present disclosure.

Referring to FIG. 2, the present disclosure relates to an organic light-emitting diode (OLED) display, including: a display panel 100, a scanning driving device 200, and a data driving device 300. It is noted that the OLED display in the present disclosure may further include other proper components, such as a timing controlling device configured to control the canning driving device 200 and the data driving device 300, and a power supply voltage generator configured to provide a positive voltage of a power supply and a negative voltage of the power supply.

Specifically, the display panel 100 may include: a plurality of pixel PX arranged in a matrix, n number of scanning lines $G_1$ to $G_N$, m number of data lines $D_1$ to $D_M$. The scanning driving device 200 connects to each of the scanning lines $G_1$ to $G_N$ and drives each of the scanning lines $G_1$ to $G_N$. The data driving device 300 connects to each of the data lines $D_1$ to $D_M$ and drives each of the data lines $D_1$ to $D_M$.

The scanning driving device 200 may provide at least one signal to each of the pixels PX, which may be described in detail later. The data driving device 300 may provide data signals to each of the pixels PX, which may also be described in detail later.

Each of the pixels PX may include a pixel driving circuit. The pixel driving circuit in the present disclosure may be described in detail as below.

Figure 3:
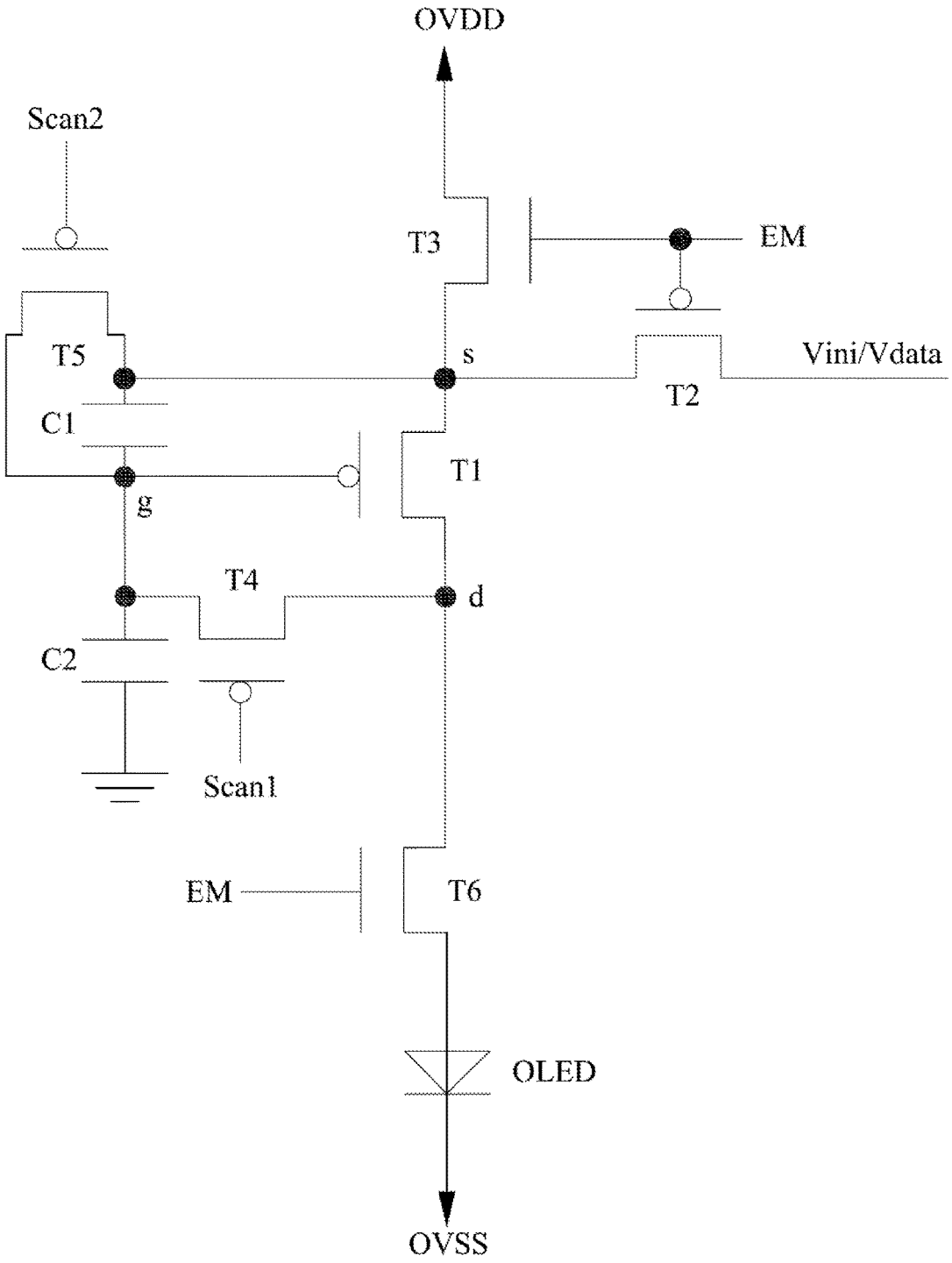
FIG. 3 is a circuit diagram of a pixel structure of the OLED display in accordance with one embodiment in the present disclosure.

FIG. 3 is a circuit diagram of a pixel structure of the OLED display in accordance with one embodiment in the present disclosure.

Referring to FIG. 3, each of the pixels PX of the OLED display may include a 6T2C pixel structure. The 6T2C pixel structure includes an OLED, a first thin film transistor (TFT) T1, a second TFT T2, a third TFT T3, a fourth TFT T4, a fifth TFT T5, a sixth TFT T6, a first capacitor C1, and a second capacitor C2.

A gate of the first TFT T1 electrically connects to a first node g. A source of the first TFT T1 electrically connects to a second node s. A drain of the first TFT T1 electrically connects to a third node d.

A gate of the second TFT T2 is configured to receive emission controlling signals EM. A source of the second TFT T2 is configured to receive initializing signals Vini or data signals Vdata, which are provided by the data driving device 300. A drain of the second TFT T2 electrically connects to the second node s.

A gate of the third TFT T3 is configured to receive the emission controlling signals EM. A source of the third TFT T3 is configured to receive the positive voltage of the power supply OVDD, which is usually provided by the power supply voltage generator (not shown in the figure). A drain of the third TFT T3 electrically connects to the second node s.

A gate of the fourth TFT T4 is configured to receive first scanning signals Scan1, which are provided by the scanning driving device 200. A source of the fourth TFT T4 electrically connects to the third node d. A drain of the fourth TFT T4 electrically connects to the first node g.

A gate of the fifth TFT T5 is configured to receive second scanning signals Scan2, which are provided by the scanning driving device 200. A source of the fifth TFT T5 electrically connects to the second node s. A drain of the fifth TFT T5 electrically connects to the first node g.

A gate of the sixth TFT T6 is configured to receive the emission controlling signals EM. A source of the sixth TFT T6 electrically connects to the third node d. A drain of the sixth TFT T6 connects to an anode of the OLED.

A cathode of the OLED is configured to receive the negative voltage of the power supply OVSS, which is usually provided by the power supply voltage generator (not shown in the figure).

One end of the first capacitor C1 electrically connects to the first node g, and the other end of the first capacitor C1 electrically connects to the second node s.

One end of the second capacitor C2 electrically connects to the first node g, and other end of the second capacitor C2 is grounded.

In one example, the first TFT T1 is a driving TFT.

In one example, the first TFT T1, the second TFT T2, the fourth TFT T4, and the fifth TFT T5 may be P-type TFTs, and the third TFT T3 and the sixth TFT T6 may be N-type TFTs, but the present disclosure may not be limited to. Further, the P-type TFT may be, for example, a PMOS TFT, and the N-type TFT may be, for example, a NMOS TFT, but the present disclosure may not be limited to. The P-type TFT and the N-type TFT may be P-type and N-type low-temperature polysilicon TFTs, or P-type and N-type amorphous silicon TFTs.

Figure 4:
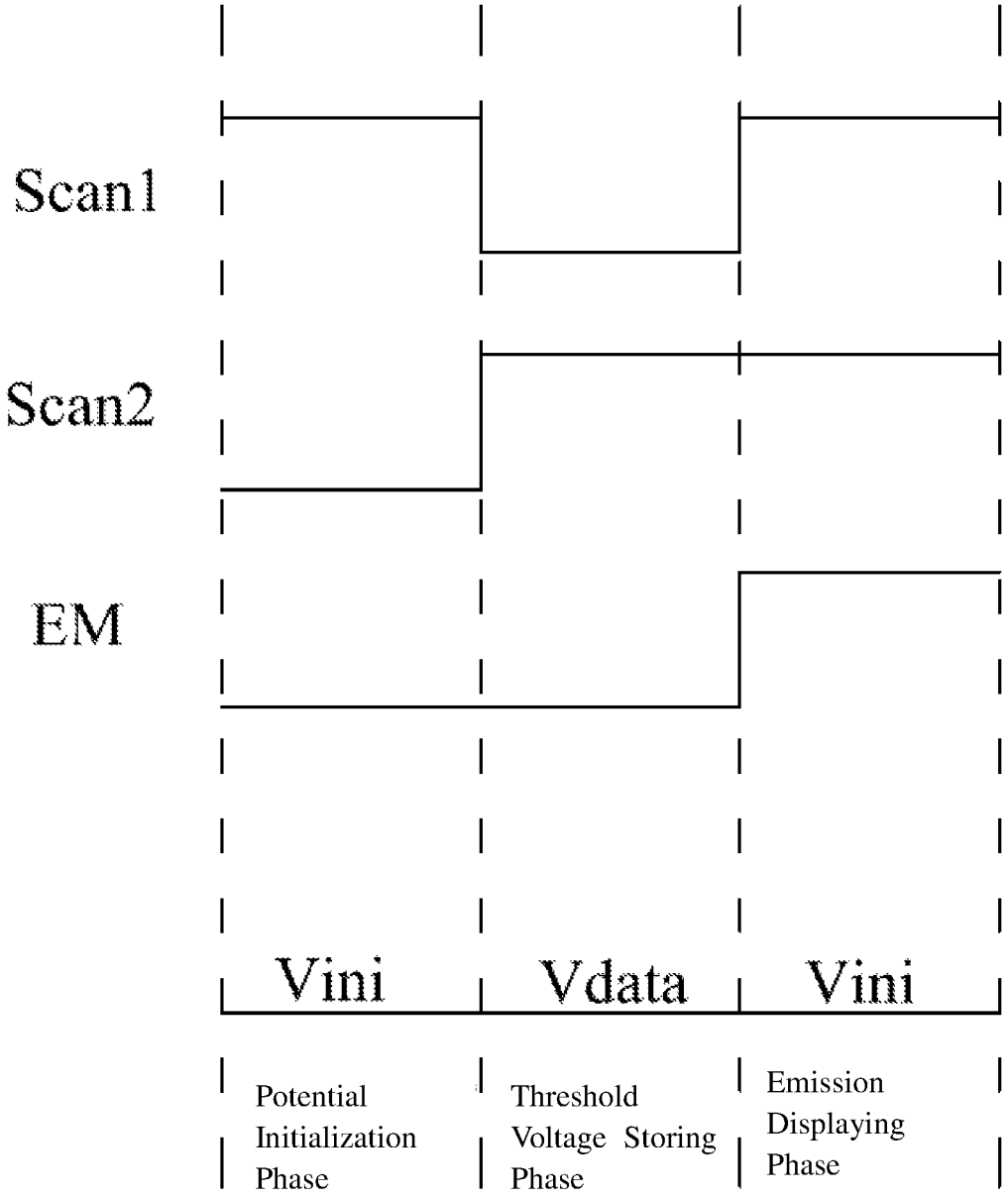
FIG. 4 is a timing diagram of each of signals in accordance with one embodiment in the present disclosure.
Figure 5A:
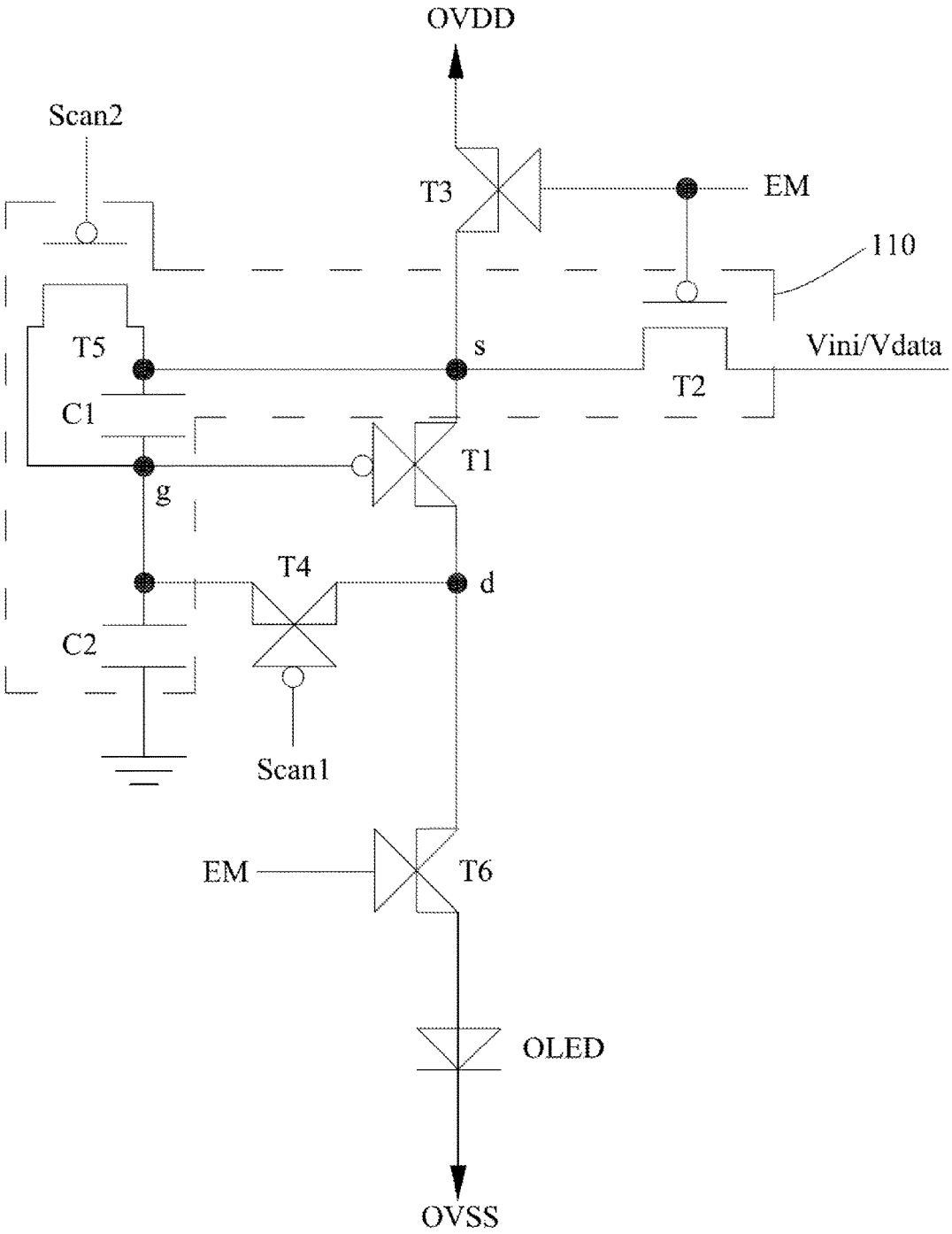
FIGS. 5A to 5C are diagrams illustrating an operational process of a pixel driving circuit in accordance with one embodiment in the present disclosure.
Figure 5B:
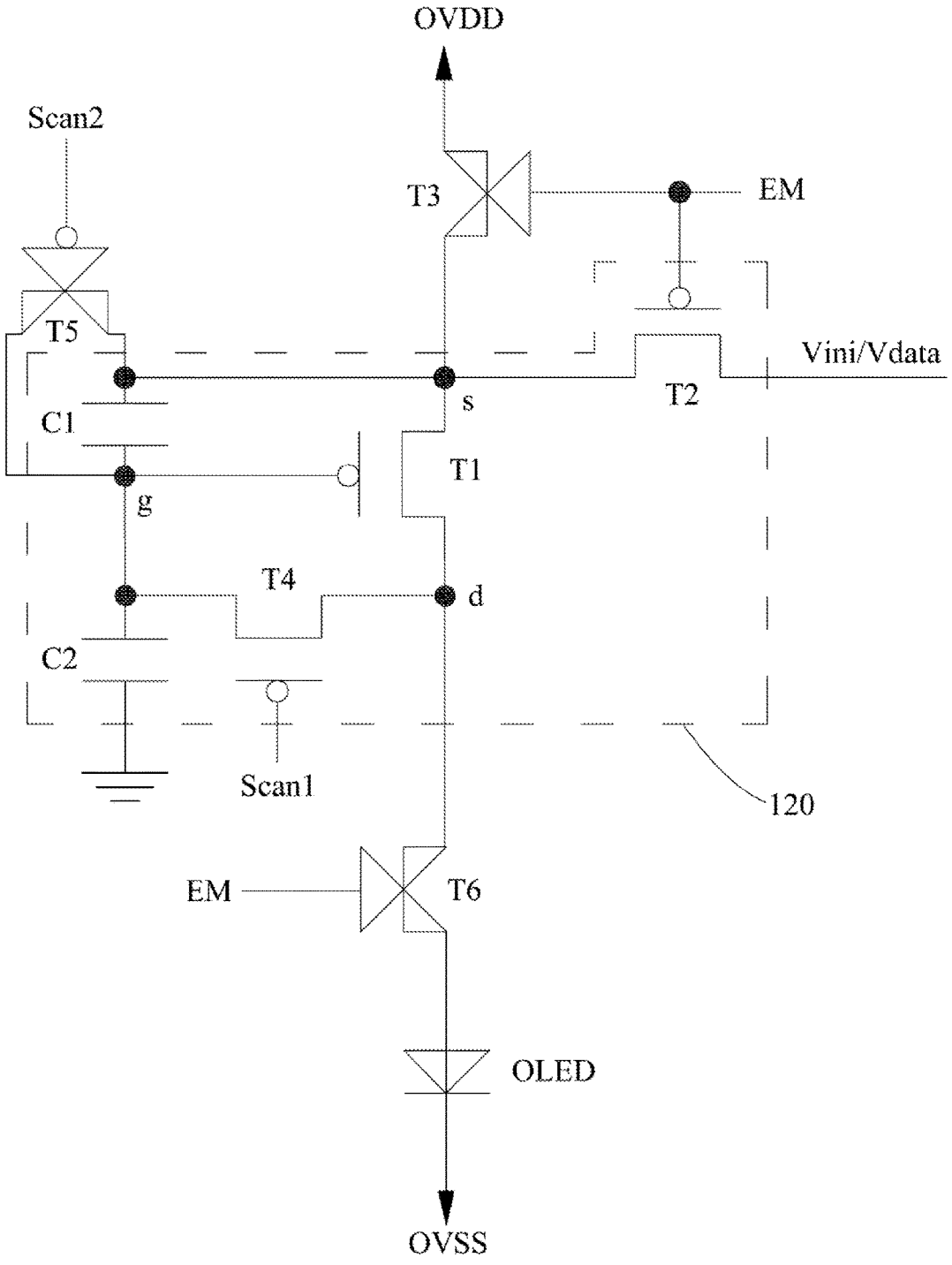
Figure 5C:
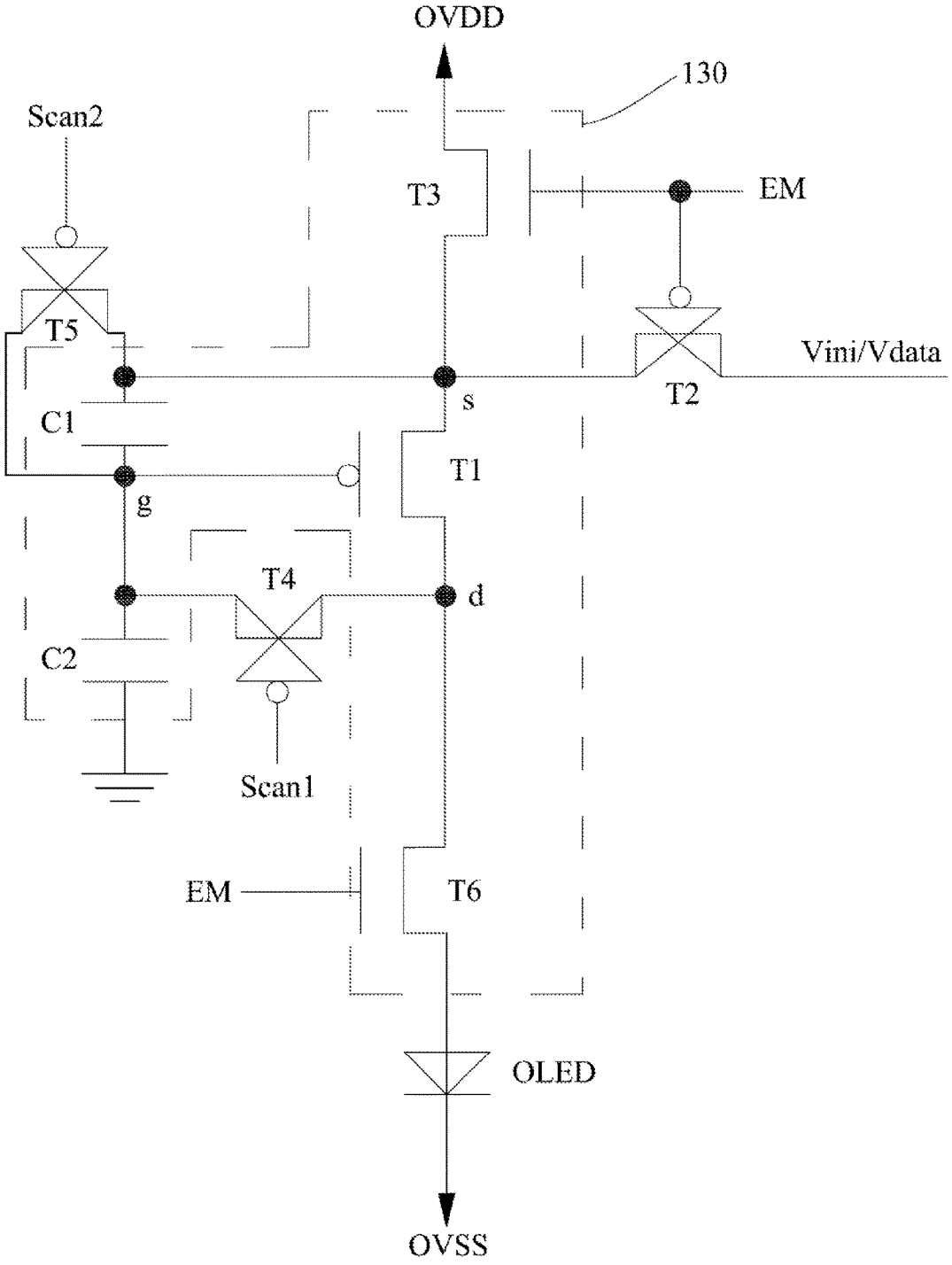

Operation principles of the pixel driving circuit in the present disclosure are described in detail as follow. In one example, the pixel driving circuit, having the structure of 6T2C, may conduct a potential initializing operation (during a potential initialization phase), a threshold voltage storing operation (during a threshold voltage storing phase), and an emission displaying operation (during an emission displaying phase). FIG. 4 is a timing diagram of each of signals in accordance with one embodiment in the present disclosure. FIG. 5A to FIG. 5C are diagrams illustrating an operational process of a pixel driving circuit in accordance with one embodiment in the present disclosure. In FIG. 5A to FIG. 5C, a "x" symbol on the TFT indicates the TFT is turned off.

Referring to FIG. 4 and FIGS. 5A to 5C, during the potential initialization phase, the emission controlling signals EM and the second scanning signals Scan2 are configured to be at a low potential, and the first scanning signals Scant are configured to be at a high potential. As such, the second TFT T2 and the fifth TFT T5 may be turned on, and the first TFT T1, the third TFT T3, the fourth TFT T4, and the sixth TFT T6 are turned off. When the source of the second TFT T2 receives the initializing signals Vini at the low potential, voltage Vs of the second node s may be equal to Vini. As such, the voltage Vs of the second node s is configured to charge the first capacitor C1 until voltage Vg of the first node g equals to Vini. Therefore, the voltage Vs of the second node s and the voltage Vg of the first node g may both equal to the initializing signals Vini, and the potential initialization process, i.e., reset, with respect to the first TFT T1 may be completed.

Further, during the potential initialization phase, as shown in FIG. 5A, a potential initialization module 110 may include the second TFT T2, the fifth TFT T5, the first capacitor C1, and the second capacitor C2. Functions of the potential initialization module 110 may be described in below.

During the threshold voltage storing phase, the emission controlling signals EM and the first scanning signals Scan1 are configured to be at the low potential, and the second scanning signals Scan2 are configured to be at the high potential. The first TFT T1, the second TFT T2, and the fourth TFT T4 are turned on, and the third TFT T3, the fifth TFT T5, and the sixth TFT T6 are turned off. When the source of the second TFT T2 receives the data signals Vdata at the high potential, the voltage Vs of the second node s may equal to Vdata. As such, the voltage Vs of the second node s is configured to charge the first capacitor C1 until voltage difference between the first node g and the second node s equals to Vth. The equation may be satisfied: Vg=Vs−Vth=Vdata−Vth, wherein Vth is the threshold voltage of the first TFT T1. The threshold voltage Vth may be stored in the first capacitor C1.

Further, during the threshold voltage storing phase, as shown in FIG. 5B, a threshold voltage storing module 120 may include the first TFT T1, the second TFT T2, the fourth TFT T4, the first capacitor C1, and the second capacitor C2. Functions of the threshold voltage storing module 120 may be described in below.

During the emission displaying phase, the emission controlling signals EM, the first scanning signals Scan1, and the second scanning signals Scan2 are configured to be at the high potential. As such, the first TFT T1, the third TFT T3, and the sixth TFT T6 may be turned on, and the second TFT T2, the fourth TFT T4, and the fifth TFT T5 may be turned off. The voltage Vs of the second node s may equal to the positive voltage of the power supply OVDD due to the third TFT T3 is turned on. According to capacitance coupling principle, the voltage of the first node g is configured to be as: Vg=Vdata−Vth+ΔV, wherein ΔV=(OVDD−Vdata)*C1/(C1+C2). The voltage difference between the first node g and the second node s is configured to be as: Vs−Vg=OVDD−(Vdata−Vth+ΔV)=OVDD−Vdata+Vth−ΔV.

As such, current I passing through the OLED may satisfy the equation:

$$I=K(Vsg-Vth)^2=K(OVDD-V\text{data}+Vth-\Delta V-Vth)^2=K(OVDD-V\text{data}-\Delta V)^2$$

K is an intrinsic conductance factor of the first TFT T1, which is determined by the characteristic of the first TFT T1.

In view of the above, ΔV is not related to the threshold voltage Vth of the first TFT T1. According to the equation of the current I, the current I passing through the OLED may not be related to the threshold voltage Vth of the first TFT. As such, improper image-displaying of the OLED display resulting from drifting of the threshold voltage Vth of the first TFT may be eliminated.

Further, during the emission displaying phase, as shown in FIG. 5C, the first TFT T1, the third TFT T3, the sixth TFT T6 turn on the first capacitor C1, and the second capacitor C2 to form an emission displaying module 130. Functions of the emission displaying module 130 may be described in below.

According to the operation principles of the pixel driving circuit described in the above, the potential initialization module 110 is configured to conduct the potential initializing operation according to the emission signals EM and the second scanning signals Scan2 at the low potential, and the first scanning signals Scant and the initializing signals Vini at the high potential during the potential initializing phase.

The threshold voltage storing module 120 is configured to conduct the threshold voltage storing operation according to the emission signals EM and the first scanning signals Scan1 at the low potential, and the second scanning signals Scan2 and the data signals Vdata at the high potential during the threshold voltage storing phase. That is, the potential of the threshold voltage Vth may be stored in the first capacitor C1.

The emission displaying module 130 is configured to drive the OLED to illuminate according to the emission signals EM, the first scanning signals Scan1, and the second scanning signals Scan2 at the high potential during the emission displaying phase.

It is believed that the present disclosure is fully described by the embodiments, however, certain improvements and modifications may be made by those skilled in the art without departing from the principles of the present application, and such improvements and modifications shall be regarded as the scope of the present application.

What is claimed is:

1. A pixel driving circuit, comprising:

a first thin film transistor (TFT), a second TFT, a third TFT, a fourth TFT, a fifth TFT, a sixth TFT, a first capacitor, a second capacitor, and an organic light-emitting diode (OLED);

a gate of the first TFT electrically connecting to a first node, a source of the first TFT electrically connecting to a second node, and a drain of the first TFT electrically connecting to a third node;

a gate of the second TFT being configured to receive emission controlling signals; a source of the second TFT being configured to receive initializing signals or data signals, and a drain of the second TFT electrically connecting to the second node;

a gate of the third TFT being configured to receive the emission controlling signals, a source of the third TFT being configured to receive a positive voltage of a power supply, and a drain of the third TFT electrically connecting to the second node;

a gate of the fourth TFT being configured to receive first scanning signals, a source of the fourth TFT electrically connecting to the third node, and a drain of the fourth TFT electrically connecting to the first node;

a gate of the fifth TFT being configured to receive second scanning signals, a source of the fifth TFT electrically connecting to the second node, and a drain of the fifth TFT electrically connecting to the first node;

a gate of the sixth TFT being configured to receive the emission controlling signals, a source of the sixth TFT electrically connecting to the third node, and a drain of the sixth TFT being configured to receive a negative voltage of the power supply;

one end of the first capacitor electrically connecting to the first node, and the other end of the first capacitor electrically connecting to the second node;

one end of the second capacitor electrically connecting to the first node, and other end of the second capacitor being grounded.

2. The pixel driving circuit according to claim 1, wherein the first TFT, the second TFT, the fourth TFT, and the fifth TFT are P-type TFTs, and the third TFT and the sixth TFT are N-type TFTs.

3. The pixel driving circuit according to claim 2, wherein the pixel driving circuit is configured to perform a potential initializing operation, a threshold voltage storing operation, and an emission displaying operation;

when the pixel driving circuit performs the potential initialization operation, the emission controlling signals and the second scanning signals are configured to be at a low potential, the first scanning signals are configured to be at a high potential, and the source of the second TFT receives the initializing signals at the low potential;

when the pixel driving circuit performs the threshold voltage storing operation, the emission controlling signals and the first scanning signals are configured to be at the low potential, the second scanning signals are configured to be at the high potential, and the source of the second TFT is configured to receive the data signals at the high potential;

when the pixel driving circuit performs the emission displaying operation, the emission controlling signals, the first scanning signals, and the second scanning signals are configured to be at the high potential.

4. The pixel driving circuit according to claim 1, wherein the first TFT, the second TFT, the fourth TFT, and the fifth TFT are P-type TFTs, and the third TFT and the sixth TFT are N-type TFTs.

5. The pixel driving circuit according to claim 4, wherein the P-type TFT is a PMOS TFT, and the N-type TFT is a NMOS TFT.

* * * * *